US009557133B2

(12) United States Patent
Rentz

(10) Patent No.: US 9,557,133 B2
(45) Date of Patent: Jan. 31, 2017

(54) HANDHELD ARCHERY RELEASE

(71) Applicant: Gregory E. Summers, Madison Heights, VA (US)

(72) Inventor: Marc T. Rentz, Madison Heights, VA (US)

(73) Assignee: Gregory E. Summers, Madison Heights, VA (US)

( * ) Notice: Subject to any disclaimer, the term of this patent is extended or adjusted under 35 U.S.C. 154(b) by 0 days.

(21) Appl. No.: 14/665,010

(22) Filed: Mar. 23, 2015

(65) Prior Publication Data

US 2016/0282079 A1 Sep. 29, 2016

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/35.2
See application file for complete search history.

(56) References Cited

U.S. PATENT DOCUMENTS 4,066,060 A * 1/1978 Napier ..... F41B 5/1469 124/35.2
4,160,437 A * 7/1979 Fletcher ..... F41B 5/1469 124/35.2
4,257,386 A * 3/1981 Gazzara ..... F41B 5/1469 124/35.2
4,316,443 A * 2/1982 Giacomo ..... F41B 5/1469 124/35.2
4,498,448 A * 2/1985 Fletcher ..... F41B 5/1469 124/35.2
4,567,875 A * 2/1986 Fletcher ..... F41B 5/1469 124/35.2
4,672,945 A * 6/1987 Carlton ..... F41B 5/1469 124/35.2
5,025,772 A * 6/1991 Stevenson ..... F41B 5/1469 124/35.2
5,653,213 A * 8/1997 Linsmeyer ..... F41B 5/1469 124/35.2
5,692,490 A * 12/1997 Walker ..... F41B 5/1469 124/35.2
5,694,915 A 12/1997 Summers
6,571,786 B2 * 6/2003 Summers ..... F41B 5/1469 124/35.2
6,631,709 B2 * 10/2003 Carter ..... F41B 5/1469 124/35.2
6,736,124 B2 * 5/2004 Carter ..... F41B 5/1469 124/35.2
6,953,035 B1 * 10/2005 Summers ..... F41B 5/1469 124/35.2
7,581,536 B2 * 9/2009 Porter ..... F41B 5/1469 124/35.2

(Continued)

*Primary Examiner* — Alexander Niconovich
(74) *Attorney, Agent, or Firm* — Leading Edge Law Group

(57) ABSTRACT

A handheld archery release includes a handle having hinged first and second members and a longitudinal axis. The second member, which is connected with the first member via a pivot pin having an axis normal to the handle longitudinal axis, is rotated relative to the first member to operate the release. An adjustable sear assembly is connected with the first member and is operable between hold and fire positions by rotation of the second member to hold and release a bowstring, respectively.

10 Claims, 4 Drawing Sheets

(56) References Cited

U.S. PATENT DOCUMENTS

| | | | | |
|---|---|---|---|---|
| 7,926,475 | B2 * | 4/2011 | Jones | F41B 5/1469 124/35.2 |
| 8,402,957 | B1 * | 3/2013 | Clark | F41B 5/1469 124/35.2 |
| 8,522,764 | B1 * | 9/2013 | LoRocco | F41B 5/1469 124/35.2 |
| 8,622,051 | B2 * | 1/2014 | Summers | F41B 5/1469 124/35.2 |
| 8,746,221 | B2 * | 6/2014 | Rentz | F41B 5/1469 124/1 |
| 8,869,781 | B2 * | 10/2014 | Jones | F41B 5/1469 124/35.2 |
| 9,027,540 | B2 * | 5/2015 | Springer | F41B 5/1469 124/31 |
| 9,250,032 | B2 * | 2/2016 | Kelly | F41B 5/1469 |
| 9,285,183 | B2 * | 3/2016 | Rentz | F41B 5/1469 |
| 2008/0149084 | A1 * | 6/2008 | Whalen | F41B 5/1469 124/35.2 |
| 2015/0219418 | A1 * | 8/2015 | Whalen | F41B 5/1469 124/35.2 |
| 2016/0025445 | A1 * | 1/2016 | Kelly | F41B 5/1469 124/35.2 |
| 2016/0138887 | A1 * | 5/2016 | Kelly | F41B 5/1469 124/35.2 |

* cited by examiner

HANDHELD ARCHERY RELEASE

BACKGROUND OF THE INVENTION

The present invention relates to an archery release, and more particularly to a handheld archery release for a bowstring suitable for use with multiple shooting styles.

Release devices are used in archery to assist the archer in pulling a bowstring to a fully drawn position and then releasing the bowstring to fire an arrow. Some release devices use grippers for engaging the bowstring or a hock mounted on the bowstring. Other release devices use a rope looped about the bowstring. Still other devices use back tension which eliminates the torque in looped rope releases. The present invention relates to a new handheld release which can be used in hinge style back tension, relax through the shot, constant motion, and increase pressure shooting methods.

BRIEF DESCRIPTION OF THE PRIOR ART

Back-tension release devices which reduce torque are well-known in the prior art as evidenced by U.S. Pat. No. 5,694,915. This patent discloses a back-tension rope release in which a catch for a rope loop is connected with a fork which in turn is connected with a handle. The orientation of the fork relative to the handle is adjustable in order to remove torque or twist from a rope loop. The catch is also adjustable relative to the fork in order to adjust the back-tension on the rope loop. Set screws are used to hold the fork and the catch in the desired positions.

Another back-tension release device is disclosed in U.S. Pat. No. 8,622,051 wherein an adjustable sear housing and an adjustable finger are provided. By adjusting the sear housing, twist or torque in a bowstring loop connected with the release can be eliminated. The speed of the release is altered via adjustment of the finger.

While the prior devices normally operate satisfactorily, they are somewhat cumbersome to operate and often require re-adjustment because the set screws loosen during repeated firing of the release. In addition, they do not accommodate various shooting styles.

SUMMARY OF THE INVENTION

The present invention was developed in order to overcome these and other drawbacks of prior archery releases by providing a hinged handheld archery release. The release includes a handle having a longitudinal axis and two hinged pieces or members. More particularly, the handle includes a first member and a second member which is connected with the first member for pivotal movement about an axis which extends normal to the longitudinal axis of the handle. The hinged release provides a consistent back tension shot timing firing sequence A sear is pivotally connected with the first member for rotation about an axis parallel to the pivot axis of the second member and a bowstring hook is pivotally connected with the first member for rotation about an axis parallel to the second member pivot axis and operable by the sear. The degree of pivotal movement of the sear may be adjusted by at least one sear screw connected with the handle second member. One end of the sear screw engages a surface of the sear and rotation of the screw adjusts the degree of pivotal movement of the sear relative to the first member.

The pressure required by an archer to activate the release by pivoting the second member relative to the first member is adjustable through the use of interchangeable springs arranged between the members. More particularly, the second member contains a slot which receives an extended portion of the first member. The slot contains a recess for receiving a spring and the first member contains a set screw opposite the recess which retains the spring within recess. By removing the screw, springs of different compressive strength can be arranged in the recess to adjust the pressure required to rotate the second member relative to the first member to a degree desired by an archer.

BRIEF DESCRIPTION OF THE FIGURES

Other objects and advantages of the invention will become apparent from a study of the following specification when viewed in the light of the accompanying drawing, in which.

DETAILED DESCRIPTION

Figure 3:
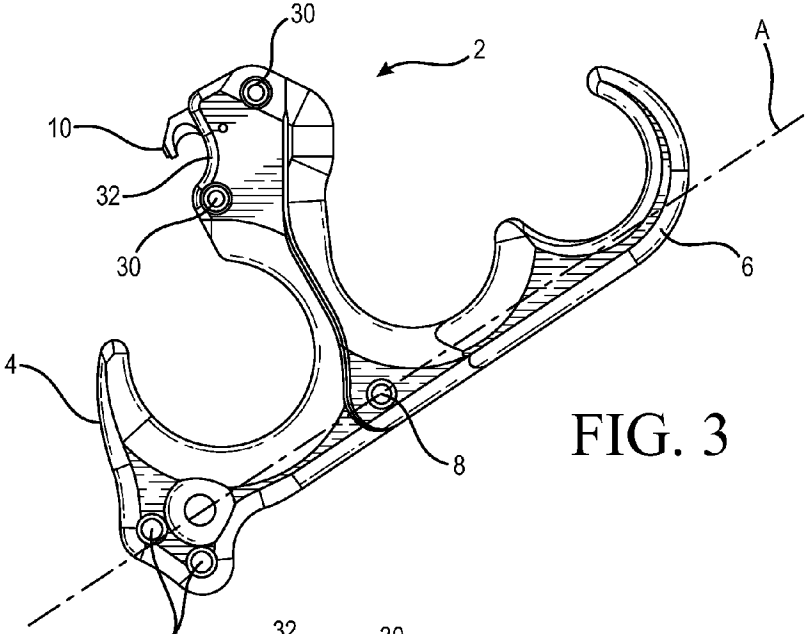
FIG. 3 is front plan view of the archery release.
Figure 4:
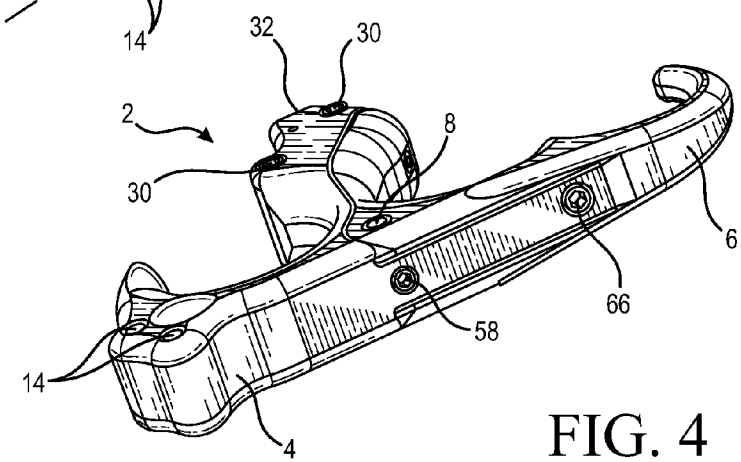
FIG. 4 is a bottom perspective view of the archery release.
Figure 2:
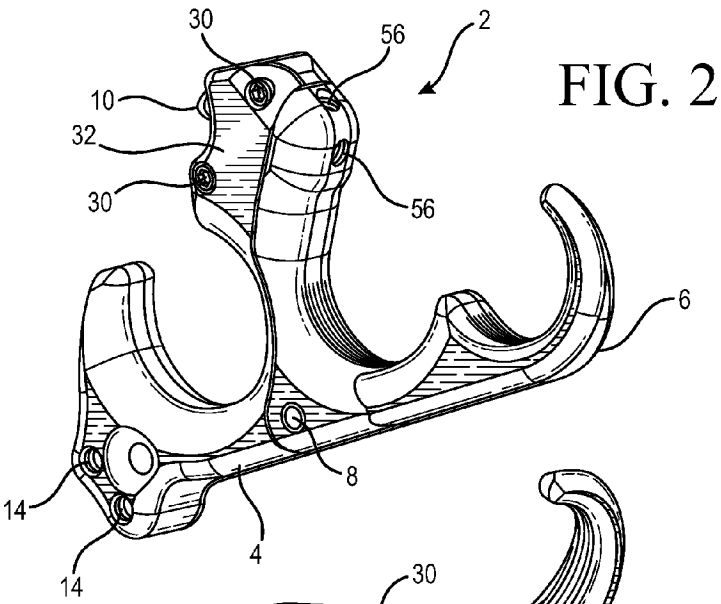
FIGS. 1 and 2 are front and rear perspective views, respectively, of the archery release according to the invention.
Figure 1:
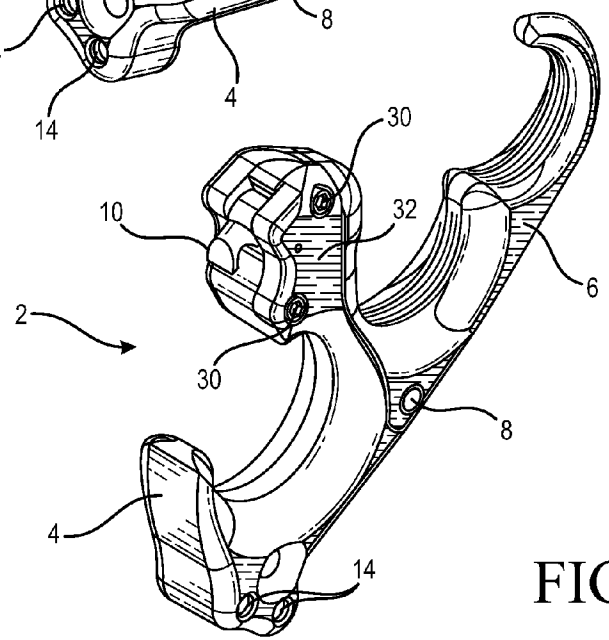

As shown in FIGS. 1-4, the handheld archery release includes a number of components which are shown in greater detail in FIGS. 6-17. More particularly, the release includes a handle 2 having a longitudinal axis A (FIG. 3) and including a first member 4 and a second member 6 which are connected via a pivot pin 8 having an axis normal to the longitudinal axis. The second member is operable by an archer to pivot about the pivot pin to operate the release. More particularly, the release includes a bowstring hook 10 which is connected with a bowstring loop (not shown) of a bow. Operation of the second member 6 of the release releases the bowstring from the hook to fire an arrow.

Figure 7:
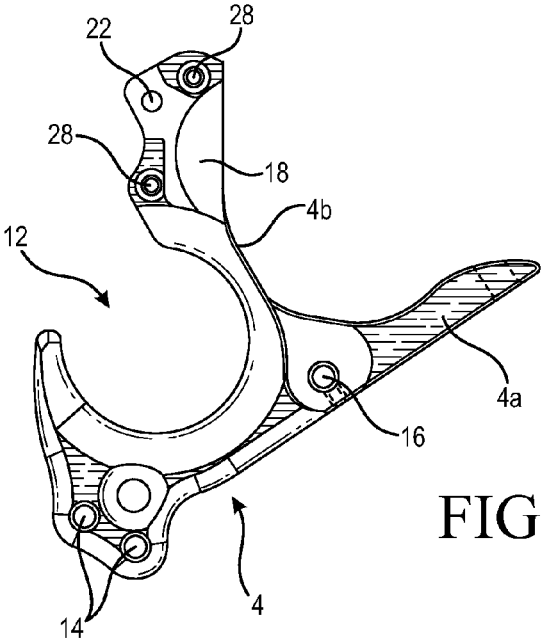
FIGS. 7-9 are front, right side, and bottom plan views, respectively, of a first member of the archery release according to the invention.
Figure 8:
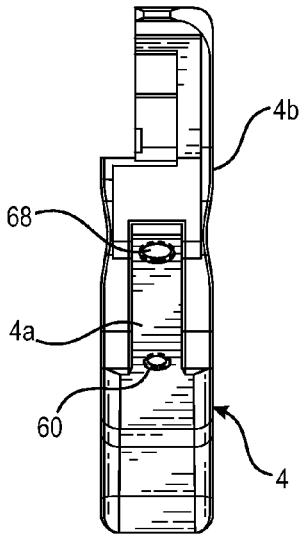
Figure 9:
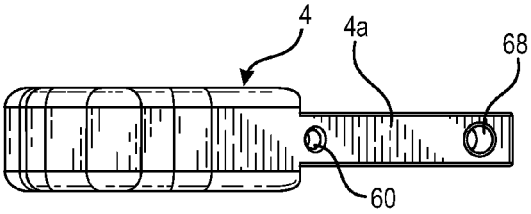
Figure 15:
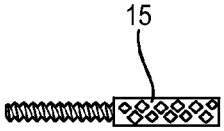
FIG. 15 is a plan view of a thumb screw for the archery release according to the invention.

The first piece or member 4 of the handle is shown in greater detail in FIGS. 7-9. The top or front surface of the first member contains a central opening 12 for receiving the index finger of an archer. Below the central opening toward its forward portion, the first member contains a spaced pair of threaded openings 14 which are adapted to receive a thumb pin 15 such as is shown in FIG. 15. The thumb pin can be arranged in either opening according to the preferences of the archer and assists with drawing a bow. The pin can also be arranged in a threaded opening from the other side of the member depending on whether the archer is right or left-handed. Below the central opening 12 and toward the rear of the first member, the first member contains a through opening 16 which receives the dowel pin 8 which connects the second member 6 with the first member when the handle is assembled. Beyond the opening 16 is an extended portion 4*a* of the first member which will be described in greater detail below. The bottom or rear surface of the first member is relatively flat.

Figure 5:
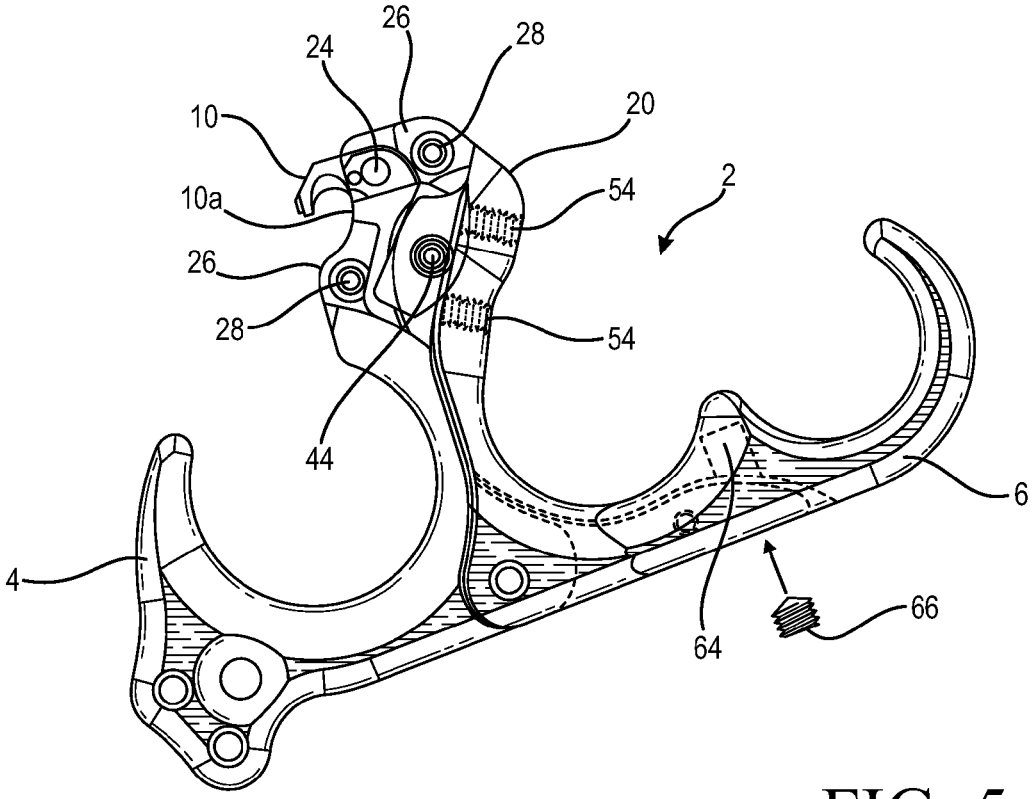
FIGS. 5 and 6 are front plan views, respectively, of the archery release in hold and release positions.
Figure 6:
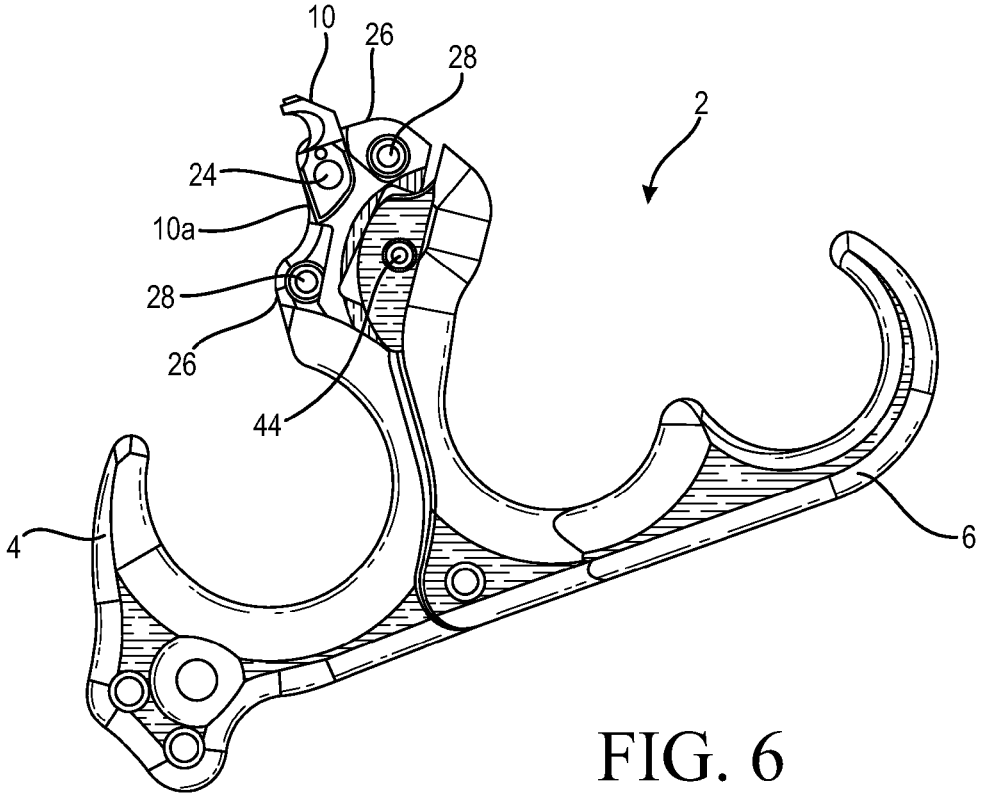

Above the opening 12, the first member 4 includes an upwardly extending portion 4*b* at the end of which is a rearwardly facing recess 18 adapted to receive a sear 20 which is shown in FIGS. 5, 6, 13 and 14 and which will be described in greater detail below. The first member further includes an opening 22 forward of the recess for receiving a pivot pin 24 which supports the bowstring hook 10. That is, the bowstring hook includes an opening for receiving the pivot pin 24 as shown in FIGS. 5 and 6 so that the bowstring hook is rotatable relative to the first member 4 about an axis parallel to the pivot axis of the second member relative to the first member and normal to the longitudinal axis A of the handle to hold or fire a bowstring loop as will be developed below. A spring (not shown) biases the hook portion to a closed position. The first member further contains raised portions 26 which contain threaded openings 28 for receiving screws 30 for retaining a cover 32 as shown in FIGS. 1-4. Moreover, the raised portions limit the rotational movement of the bowstring hook about the pivot pin 24 relative to the first member 4.

Figure 10:
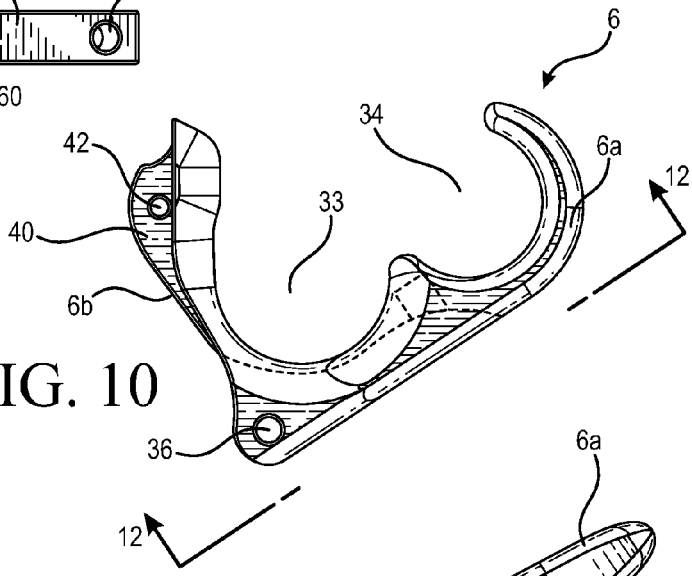
FIGS. 10-12 are front, right side, and bottom plan views, respectively, of a second member of the archery release according to the invention.
Figure 11:
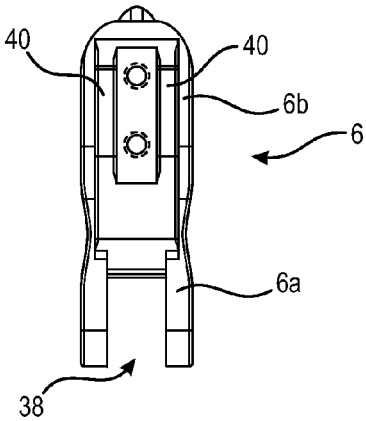
Figure 12:
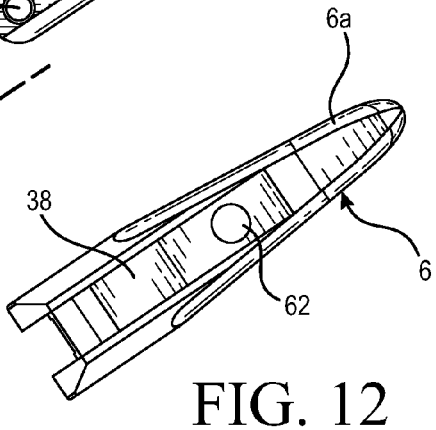

Referring now to FIGS. 10-12, the second member 6 of the handle will be described. The handle second member has a rearwardly extending portion 6*a* having a front or top surface which includes recesses 33 and 34 for receiving the middle and ring fingers, respectively, of the archer. Although the preferred embodiment of the release according to the invention includes a second member for receiving two fingers of the archer, it will be appreciated that one or three recesses may be provided to accommodate one to three fingers of the archer. At the lower forward portion of the member 6 is provided a through opening 36 which receives the pivot pin 8 which connects the second member 6 with the first member 4 as shown in FIGS. 1-6. The lower surface of the rearwardly extending portion is relatively flat and includes a recess 38 for receiving the extended portion 4*a* of the first member 4 when the members are connected.

Extending upwardly from the opening 36 is an arm portion 6*b* of the second member 6 which extends adjacent to the upward portion 4*b* of the first member when the members are connected as shown in FIGS. 1-6. The arm portion includes a pair of spaced projections 40 containing aligned openings 42 for receiving a pin which connects the sear with second member. The sear is arranged in the space defined between the projections. This space, without the sear, is shown in FIG. 11. The projections are contoured to conform with the contour of the recess 18 in the first member upper portion 4*b* as shown in FIGS. 5 and 6. The arm portion 6*a* of the second member 36 also contains an opening 42 for receiving a pin 44 (FIGS. 5 and 6) to pivotally connect the sear with the arm portion.

Figure 13:
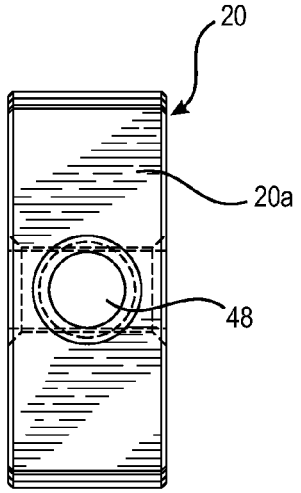
FIGS. 13 and 14 are front and right side plan views, respectively, of the sear of the archery release according to the invention.
Figure 14:
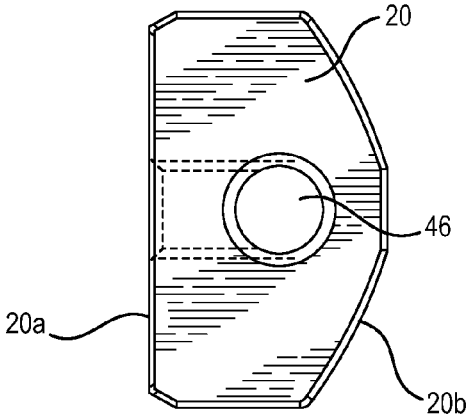

The sear 20 is shown in FIGS. 13 and 14. It includes a lateral opening 46 for receiving the pin 44 for rotatable connection with the arm portion 6*b* of the second arm 6. The axis of rotation of the sear is parallel to the pivot axis of the handle between the first and second members thereof and normal to the longitudinal axis A of the handle. The forward surface 20*a* of the sear is generally planar. The forward surface contains a threaded opening 48 adapted to receive a set screw (not shown) which abuts against the pin 44 when the sear is assembled to retain the pin.

The sear 20 and bowstring hook 10 together form a sear assembly. The bowstring hook 10 includes a gate portion 10*a* which engages the top of the sear when the hook portion is in the closed or ready position shown in FIG. 5. The sear thus retains the bowstring hook in the closed position against the force of the bow draw weight. When the sear is pivoted upon movement of the second member away from the first member 4, the gate portion is released and the hook pivots under the force of the bow draw weight to the fire position shown in FIG. 6 to release the bowstring.

Figure 16:
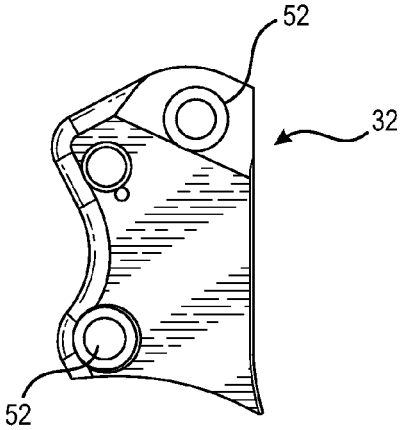
FIGS. 16-18 are front, right side, and rear views, respectively, of a sear cover for the archery release according to the invention.
Figure 17:
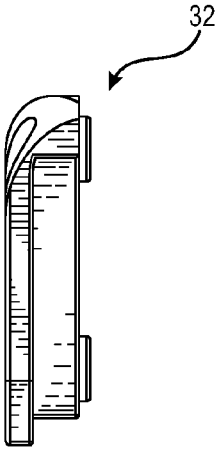
Figure 18:
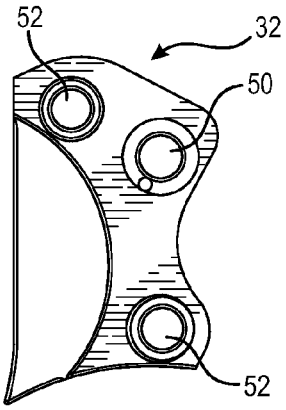

The sear assembly is covered by the cover 32 shown in FIGS. 16-18. The cover contains a recess 50 for receiving the pin for the bowstring hook, the hook spring (not shown), and a pair of threaded openings 52 for receiving the screws 30 which connect the cover with the first member 4.

The release is assembled as follows. First, the sear 20 and sear pin 44 are connected with the second member 6. Next, the second member 6 is connected with the first member 4 via the pivot pin 8, with the upwardly extending arm portions 4*b* and 6*b* being arranged adjacent one another and the rearwardly extending portion 4*a* of the first member being arranged in the slot 30 of the second arm member. A screw 58 passes through an opening 60 in the first member and abuts against the pivot pin 9 to hold the first and second members together. The bowstring hook 10 and pin 24 are connected with the first member and the cover 32 is connected with the first member. If desired, the thumb pin 15 is connected with the first member as well.

Once assembled, the release includes features which enable the archer to adjust the operation of the release in accordance with the archer's personal preferences. One adjustment is provided in relation to the pivotal movement of the sear which releases the bowstring hook. As shown in FIGS. 2, 4, 5, and 11, the upper arm portion 6*b* of the second member contains a pair of spaced threaded openings 54 which receive set screws 56 which abut against the surface of the sear 20 at locations above and below the opening in the sear about which the sear rotates. By adjusting the set screws, the degree of pivotal movement of the sear to release the hook can be adjusted by the archer.

Another adjustment within the release is with regard to the force required to pivot the second member 6 relative the first member 4. As shown in FIGS. 8 and 9, the rearwardly extending portion 6*a* of the second member 6 contains a recess 62 in which a compression spring 64 (FIG. 5) is arranged. The spring 64 is retained in the recess 62 by a screw 66 passing through a threaded opening 68 in the extended portion 4*a* of the first member. By removing the screw, springs of different compression can be arranged in the recess according to the preferences of the archer.

The operation of the handheld assembly will now be described. The hook 10 engages a bowstring loop on a bow. The archer then places his or her index finger in the recess 12 of the first member 4 and the middle and ring fingers in the recesses 33, 34 of the second member 6. The flat surfaces of the second members are gripped in the archer's palm. Activation to release the bowstring loop is achieved when the second member is rotated away from the first member. That is, the second member is rotated from a first hold position shown in FIG. 5 where the first and second member flat portions are arranged in the same plane which is generally parallel to the longitudinal axis of the handle to a second release position shown in FIG. 6. where the upper portions of the first and second members are slightly separated and the flat portions of the first and second members are arranged in separate planes at a slight angle relative to one another. When the two members of the handle hinge, the sear is moved away from the gate portion of the hook 10 a sufficient distance to release the gate portion which drops over the end of the sear under the force of the bow draw weight and releases the bowstring loop to fire an arrow on the bowstring.

The handheld archery release provides a consistent back tension shot timing firing sequence. As compared to a traditional hinge release wherein the handle must rotate to a specific preset angle, the subject handheld archery release fires at a consistent time that begins when the fingers apply pressure to fire the release in accordance with the archer's preset sear travel setting and chosen spring tension, regardless of the angle of the handle when the fingers first begin to apply the necessary pressure. The release activates consistently while using any back tension method, whether the archer chooses to activate the release by relaxation of muscles in the hand and index finger, by applying increasing tension that rolls the handle in a hinge rotation due to steady squeezing through closing the fingers applying increasing tension to fire the shot, or keeping all fingers and hand motions fixed and simply pulling through similar to a tension activated release.

While the preferred forms and embodiments of the invention have been illustrated and described, it will become apparent to those of ordinary skill in the art that various changes and modifications may be made without deviating from the inventive concepts set forth above.

What is claimed is:

1. A back tension archery release, comprising a hinged handle having a longitudinal axis and comprising independent first and second members extending along said longitudinal axis and configured to be gripped by an archer between a palm and fingers of the archer, said second member being connected with said first member for movement relative to said first member about a pivot axis normal to said longitudinal axis to operate the release.

2. An archery release as defined in claim 1, and further comprising a sear assembly connected with said handle and operable between hold and fire positions upon pivotal movement of said second member to hold and release a bowstring, respectively.

3. An archery release as defined in claim 2, wherein said sear assembly includes a sear pivotally connected with said first member for rotation about an axis parallel to said pivot axis and a bowstring hook pivotally connected with said first member for rotation about an axis parallel to said pivot axis and operable by said sear.

4. An archery release as defined in claim 3, and further comprising a pin extending along said pivot axis to pivotally connect said second member with said first member.

5. An archery release as defined in claim 3, wherein said second member contains a slot extending parallel to said longitudinal axis and said first member includes a portion which extends into said second member slot beyond said pin, said second member being operable by an archer to pivot away from said first member to pivot said sear to said fire position.

6. An archery release as defined in claim 5, and further comprising a thumb pin threadably connected with said first member, said thumb pin being engaged by an archer to assist with pivotal movement of said second member relative to said first member.

7. An archery release as defined in claim 5, and further comprising a spring between said second member and said first member portion to control a pressure required to pivot said second member relative to said first member toward said release position and to return said first member to said hold position.

8. An archery release as defined in claim 7, wherein said second member contains a recess for receiving said spring and said first member portion contains a set screw which engages said spring.

9. An archery release as defined in claim 3, wherein said second member includes at least one sear screw having an end which engages said sear and is operable to adjust a range of pivotal movement of said sear.

10. A back tension archery release, comprising a hinged handle having a longitudinal axis and including independent first and second members extending along said longitudinal axis when the release is in a first position to retain a bowstring, said second member being connected with said first member for movement relative to said first member about a pivot axis normal to said longitudinal axis to a second position to operate the release to fire the bowstring, said first and second members each having front and rear surfaces, said front surfaces containing at least one recess for receiving a finger of an archer and said rear surfaces being relatively flat for gripping by a palm of the archer, said relatively flat surfaces of said first and second members being contained in the same plane when the release is in said first position and in different planes arranged at an angle when the release is in the second position.

* * * * *